US010918213B2

(12) United States Patent
Fryer

(10) Patent No.: US 10,918,213 B2
(45) Date of Patent: Feb. 16, 2021

(54) ERGONOMIC WORK STATION CHAIR

(71) Applicant: DYNAMIC DISC DESIGNS CORP., Nanaimo (CA)

(72) Inventor: Jerome Fryer, Nanaimo (CA)

(73) Assignee: Dynamic Disc Designs Corp. (CA)

( * ) Notice: Subject to any disclaimer, the term of this patent is extended or adjusted under 35 U.S.C. 154(b) by 36 days.

(21) Appl. No.: 16/453,845

(22) Filed: Jun. 26, 2019

(65) Prior Publication Data

US 2019/0313804 A1 Oct. 17, 2019

Related U.S. Application Data

(63) Continuation-in-part of application No. PCT/CA2017/000268, filed on Dec. 18, 2017.

(30) Foreign Application Priority Data

Dec. 30, 2016 (CA) ..... 2953773

(51) Int. Cl.
*A47C 9/00* (2006.01)
*A47C 7/54* (2006.01)

(52) U.S. Cl.
CPC ..... *A47C 9/002* (2013.01); *A47C 7/54* (2013.01)

(58) Field of Classification Search
CPC ..... A47C 9/002; A47C 7/54
See application file for complete search history.

(56) References Cited

U.S. PATENT DOCUMENTS 4,650,249 A 3/1987 Serber
4,832,407 A 5/1989 Serber
4,943,117 A 7/1990 Brown
6,619,747 B2 9/2003 Ko
6,938,956 B1 9/2005 Piretti
7,104,606 B2 9/2006 Congleton
7,147,282 B2 12/2006 Hatcher
7,618,090 B2 11/2009 Grenon
7,837,274 B2 11/2010 Abdoli-Eramaki
2010/0295357 A1 11/2010 Koehler

FOREIGN PATENT DOCUMENTS

WO WO2015106165 7/2015

OTHER PUBLICATIONS

WIPO, Canadian International Searching Authority, International Search Report dated Apr. 4, 2018, International Patent Application No. PCT/CA2017000268, 4 Pages.
WIPO, Canadian International Searching Authority, Written Opinion of the International Searching Authority dated Apr. 4, 2018, International Patent Application No. PCT/CA2017000268, 7 Pages.

*Primary Examiner* — Anthony D Barfield
(74) *Attorney, Agent, or Firm* — Baumgartner Patent Law; Marc Baumgartner

(57) ABSTRACT

A ventral support for use in an ergonomic work station chair, the ventral support comprising an adjustable Y axis member and a support unit, the support unit pivotally and extendibly attached to the adjustable Y axis member, wherein the support unit is heart-shaped and includes a rear, a face, and a top therebetween, the face including a right lobe and a left lobe, a clavicles support, which has a right side and a left side, is raised, is proximate the top and is horizontally disposed, and a central ridge, which extends vertically downward from the clavicles support, wherein the right lobe, the right side and the central ridge define a right concavity in the face and the left lobe, the left side and the central ridge define a left concavity in the face.

20 Claims, 6 Drawing Sheets

ERGONOMIC WORK STATION CHAIR

CROSS REFERENCE TO RELATED APPLICATIONS

This application is a Continuation-in-Part of International Patent Application No. PCT/CA2017/000268, filed Dec. 18, 2017, which claims the benefit of Canadian Patent Application No. 2953773, filed Dec. 30, 2016. The above-identified priority patent applications are incorporated herein by reference in their entirety.

FIELD

The present technology is directed to an ergonomic work station chair that provides ventral support to a user. More specifically, it is a chair that supports a user vertically on the sternum and across the clavicles thereby promoting a healthier sitting posture.

BACKGROUND

For many years designers have attempted to improve the ergonomics of chairs.

Much of the focus has been on office chairs, where people sit for prolonged periods of time. People similarly sit for long periods of time while sitting outside or in front of the TV. Regardless of the reason for a person to remain sedentary for extended periods of time, doing so has been associated with an increase in chronic medical problems, such as musculoskeletal disorders (MSDs) and compression within cartilaginous structures of the spine.

A variety of techniques have been used in an attempt to assist in curtailing the negative effects of sitting and helping to prevent end-range flexion of the lumbar spine and the onset of MSDs and other related ailments. The use of a contoured back structure combined with an adjustment mechanism is a common attempted solution. This may be built into the chair, or may be provided as a separate pad. The back structure is often required to be adjusted by the user. Because the natural tendency is to lean forward, the support is in behind and often not utilized. What occurs is a forward leaning of the upper body making the back-supporting structure not functional leading to the shoulders to slouch forward and creating flexion of the lumbar spine as well as anterior head carriage.

An example of an adjustable backrest is in U.S. Pat. No. 7,147,282 B2. A backrest has a depth adjustment mechanism which allows adjustment of the backrest assembly in a front-to-back manner with respect to the seat. The backrest assembly generally includes a backrest frame supporting the backrest. The backrest frame includes opposite end portions, and at least one of the end portions includes a backrest depth adjustment mechanism. The backrest depth adjustment mechanism includes a stationary portion and a movable portion, wherein the movable portion is movable with respect to the stationary portion. An actuator mechanism allows the user to actuate the backrest depth adjustment mechanism to move the backrest to a desired depth position.

Similarly, U.S. Pat. No. 6,938,956 is to a double backrest to provide lumbar support to the worker through the use of two separate backrest members that employ a variety of adjustment mechanisms. It only provides support for as long as the worker rests his or her back on the support.

Yet another example is in U.S. Pat. No. 6,655,731, where an adjustment mechanism that leads to complex adjustments and difficulty in replicating the desired position is provided.

Other approaches utilize unconventional designs that position workers in fundamentally different positions than a traditional chair. One such position includes providing ventral support to the worker. These designs can lead to complexity and difficulty in use, especially when the worker mounts or dismounts the chair. For example, U.S. Pat. No. 4,650,249 discloses an ergonomic support system for a person in a seated position comprised of torso support platform, a seat, a shin support platform all supported by a main frame generally the size of a common chair, related attachments for facial and arm supports, further includes a pelvic tilt seat for the system to allow alignment of the body and unimpeded movement of the arms and pelvis and a healthy and comfortable position of the spine. The support platforms are preferably padded and shaped to fit the users body telescoping legs for distance adjustment coupled to a pivotal joints for angular adjustment and sliding joints for height and lateral adjustment provide flexibility for these platforms to adjust to an individual body in various positions.

Other forms of ventral support include a rest that may provide both ventral and dorsal support. With these devices, the rest is simply placed on the floor or workstation and the user leans against the rest while standing. However, these ventral-support devices having this dual capability are "stand and lean" devices. As these devices are designed for standing users, each is limited to the specific height of the present user. When a user of a different height replaces the current user, such as after changing shifts, another stand and lean device must be used for the new user.

Another approach is a rest that has two brackets to mount the rest to the chair: one on the front of the chair (for ventral support) and one on the rear of the chair (for dorsal support). With these devices, the rest may be mounted to the first bracket to provide ventral support. To change the configuration, the user must get out of the chair, remove the rest, and insert the rest into the second bracket. Again, this configuration requires two separate pieces of equipment, which may lead to the rest becoming misplaced.

U.S. Pat. No. 7,104,606 overcomes some of the difficulties of the prior art. The support apparatus is movably attachable to a seating device to selectively provide both dorsal and ventral support to a seated user. The support apparatus is movable, by a user in the seated position, between the position providing ventral support and the position providing dorsal support. Also described is a method of selectively supporting either the ventral or dorsal side of a user by one apparatus, the apparatus moveable by a user in the seated position. This is a simple design, but does not take into consideration the fact that the chair seat is unidirectional, and therefore the user will be seated on it backwards when used in the second position (presumably the ventral position). Further, the support apparatus is designed to be used for dorsal and ventral support and therefore has no features that are specific to supporting the user in either position. Essentially, the support apparatus is not ergonomic.

U.S. Pat. No. 7,618,090 discloses an abdominal support swivel chair that is comprised of a support base with a plurality of leg arms having casters and radiating about the base frame in a common horizontal plane. An adjustable center post assembly extends vertically from the center of the support base and along a central vertical axis. A seat is secured to a frame connected at a top end of the center post. The seat has a rear buttocks support section and a central narrow frontal projecting section merging therewith through opposed side thigh cavities. An abdominal support pad is secured to an adjustable support arm connected to the saddle frame. The support arm has an upper securing end section adapted for securement of the abdominal support pad and to position same inclined forwardly. The adjustable support arm extends forwardly of the frontal projecting section and aligned therewith and has an adjustable connecting mechanism to position the abdominal support pad for the comfort of a user person above the frontal projecting section. This chair is specifically configured to support the abdomen, which, with pressure, will deform over time leading to postural changes. It therefore is not shaped to accept skeletal structures and is not ergonomic.

U.S. Pat. No. 7,837,274 discloses a device is provided for supporting a portion of the upper body during forward lean. The device comprises a hinge joint provided on a base plate. A central pillar extends upwards from the hinge joint, the hinge joint enabling movement of the central pillar through a range of motions. A support plate is situated on the central pillar at an opposite end from the hinge joint, the support plate providing support to a user in the region of the user's breast plate. At least one resistor element is operably associated with the central pillar to receive stresses delivered via at least one linkage unit during periods of forward lean, thereby transferring at least a portion of the upper body weight to the at least one resistor element. The support is not shaped to accept a portion of the human body and is simply a plate.

An alternative to this is the use of a ball. The ball provides no upper body support, but allows the user to change their position over time. While the ball is supposed to reduce the stresses associated with prolonged sitting, it causes overactivation of muscles, leading to fatigue and poor posture.

None of the prior art encourages the secondary curves while reducing the primary curves of a user's spine. In other words, promoting neutral lordosis in the lumbar and cervical spine while minimizing thoracic kyphosis. A posterior supporting structure does not encourage the reduction of thoracic kyphosis and in turn, encourages end-range lumbar flexion and forward head carriage.

What is needed is an ergonomic chair that improves a user's posture and encourages correct spinal positioning, especially with regard to lordosis and the ability to buttress and offload the lower spine. It would preferably support the user at the lower sternum, mid sternum, upper sternum and clavicles and therefore indirectly through the thoracic ribs encourage the thoracic spine into a chest-up posture, reducing thoracic kyphosis and encouraging lumbar lordosis through an anterior pelvic tilt. It would be preferable if the support was shaped to reduce both pressure and contact with the soft tissue of the chest. It would additionally be preferable if there were arm supports to promote decompression of the lumbar and thoracic spine that were at a convenient position to off-load while working during the task of typing, for example. It would be further preferable if the seat portion was configured to allow for a user to adjust their pelvic tilt. It would be further preferable if the support members were adjustable.

SUMMARY

The present technology is directed to an ergonomic chair that not only reduces compression and poor posture, but promotes correct spinal alignment and positioning. This is especially with regard to encouraging lordosis in the lumbar and cervical spine and the ability to use the forearms to offload the spine through the forearm support. The user is supported on the lower, middle, and upper sternum as well as the clavicles and this combination of support causes the user to adopt a more standing-like posture with their curvature of the cervical, thoracic and lumbar spine. The support is shaped to reduce both pressure and contact with the soft tissue of the chest. There are forearm supports to encourage spinal decompression and minimize compression of the lower thoracic and lumbo-sacral spine. The seat portion us shaped with a slight radius from the distal end to the proximal end that allows a user to adjust their pelvic tilt by shifting fore or aft. The supports are all adjustable for different sizes and shapes of users.

In one embodiment, a ventral support for use in an ergonomic work station chair is provided, the ventral support comprising: a support unit; a Z axis member; and an Y axis member, the support unit including a face, a rear and a top therebetween, the face and the top defining a corner, the face including a right lobe, a left lobe, a clavicles support zone proximate the corner, and a central ridge, which is a sternum support, the central ridge extending vertically between the right lobe and the left lobe, each lobe and the ridge defining a concavity in the face, the Z axis member including a distal end and a proximal end, the proximal end attached to the rear and the distal end attached to the Y axis member.

In another embodiment, a ventral support for use in an ergonomic work station chair is provided, the ventral support comprising: a support unit; a Z axis member; and an Y axis member, the support unit including a clavicles support, which is horizontally disposed, and a sternum support, which is attached centrally to the clavicles support and extends vertically downward, both the clavicles support and the sternum support including a face and a back, the clavicles support including a top, the Z axis member including a distal end and a proximal end, the proximal end attached to the rear and the distal end attached to the Y axis member.

In the ventral support the support unit may be heart shaped, the face and the top defining a corner, the face including a right lobe, a left lobe, a clavicles support zone, which includes the clavicles support and is proximate the corner, and a central ridge, which includes the sternum support, the central ridge extending vertically between the right lobe and the left lobe, each lobe and the ridge defining a concavity in the face.

In the ventral support, the Z axis member may be adjustably attached to one or more of the rear and the Y axis member.

The ventral support may further comprise a second Z axis member adjustably attached to one or more of the rear and the Y axis member, the second Z axis member disposed below the Z axis member.

In the ventral support, the Y axis member may include adjustors for adjustable attachment to the ergonomic work station chair.

In the ventral support, the support unit may comprise a foam having a Shore 00 durometer rating of about 70 to 90.

In the ventral support, the support unit may be heart shaped.

In another embodiment, an upper body support for use in an ergonomic work station chair is provided, the upper body support comprising: an adjustable Y axis member; a support unit; and a Z axis member, the support unit including a face, a rear and a top therebetween, the face and the top defining a corner, the face including a clavicles support zone proximate the corner, a right lobe, a left lobe, and a central ridge, which is a sternum support, the central ridge extending vertically between the right lobe and the left lobe, each lobe and the ridge defining a concavity in the face, the Z axis member including a distal end and a proximal end, the proximal end attached to the rear and the distal end attached to the Y axis member.

In the upper body support, the Z axis member may be adjustably attached to one or more of the rear and the Y axis member.

The upper body support may further comprise a horizontal forearm member and a pair of forearm supports mounted thereon, the horizontal forearm member mounted on the adjustable X axis member normal to the Y axis member.

The upper body support may further comprise a Y axis member length adjustor mounted on the adjustable Y axis member for adjusting a length of the Y axis member.

The upper body support may further comprise a second Z axis member adjustably attached to one or more of the rear and the Y axis member, the second Z axis member disposed below the Z axis member.

The upper body support may further comprise a forearm support height adjustor mounted on the adjustable Y axis member for moving the horizontal forearm member up and down.

In yet another embodiment, an ergonomic work station chair is provided, the chair comprising a plurality of legs, a seat post centrally mounted on the plurality of legs, a seat mounted on the seat post and an upper body support, the upper body support including: an adjustable Y axis member; a support unit; and a Z axis member, the support unit including a face, a rear and a top therebetween, the face and the top defining a corner, the face including a clavicles support zone proximate the corner, a right lobe, a left lobe, and a central ridge, which is a sternum support, the central ridge extending vertically between the right lobe and the left lobe, each lobe and the ridge defining a concavity in the face, the Z axis member including a distal end and a proximal end, the proximal end attached to the rear and the distal end attached to the Y axis member, the adjustable Y axis member adjustably attached to the seat.

In the ergonomic work station chair, the Z axis member may be adjustably attached to one or more of the rear and the Y axis member.

The ergonomic work station chair may further comprise a horizontal forearm member and a pair of forearm supports mounted thereon, the pair of forearm supports mounted on the horizontal forearm member normal to the Y axis member and extending horizontally rearward towards the distal end of the seat.

The ergonomic work station chair may alternatively comprise a pair of arms and a pair of forearm supports mounted thereon, the pair of arms attached to the seat post or an underside of the seat, the forearm supports extending horizontally rearward towards the distal end of the seat.

The ergonomic work station chair may further comprise a Y axis member length adjustor mounted on the adjustable Y axis member for adjusting a length of the Y axis member.

The ergonomic work station chair may further comprise a second Z axis member adjustably attached to one or more of the rear and the Y axis member, the second Z axis member disposed below the Z axis member.

The ergonomic work station chair may further comprise a forearm support height adjustor mounted on the adjustable Y axis member for moving the horizontal forearm member up and down.

In the ergonomic work station chair, the support unit may comprise a foam having a Shore OO durometer rating of about 70 to 90.

In the ergonomic work station chair, the support unit may be heart shaped.

In the ergonomic work station chair, the seat may have a broader distal end and a narrower proximal end, the proximal end proximate the adjustable Y axis member.

In yet another embodiment, a method of promoting a user's natural cervical lordosis and lumbar lordosis is provided, the method comprising: the user sitting in a chair, the chair including a clavicles support, an upper sternum support and a pair of forearm supports; the user contacting the clavicles support with their clavicles and the upper sternum support with their upper sternum; and leaning into the clavicles support and the upper sternum support, thereby promoting the user's natural cervical lordosis and lumbar lordosis.

The method may further comprise the user decompressing the lumbar spine by pressing their forearms into a forearm support.

The method may further comprise adjusting the supports to maximize proper positioning of the user.

FIGURES

Figure 1:
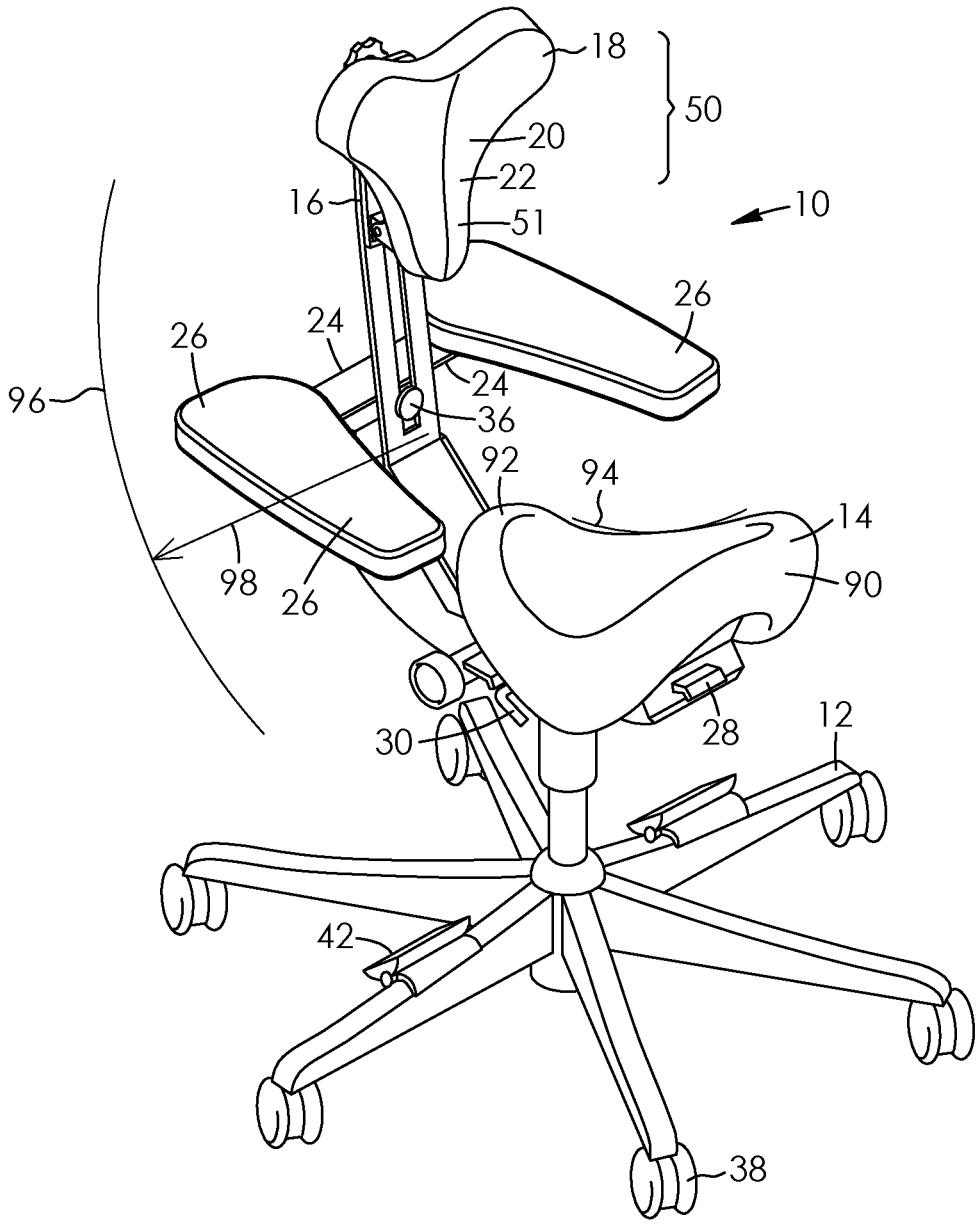
FIG. 1 is a perspective view of the chair of the present technology.
Figure 3A:
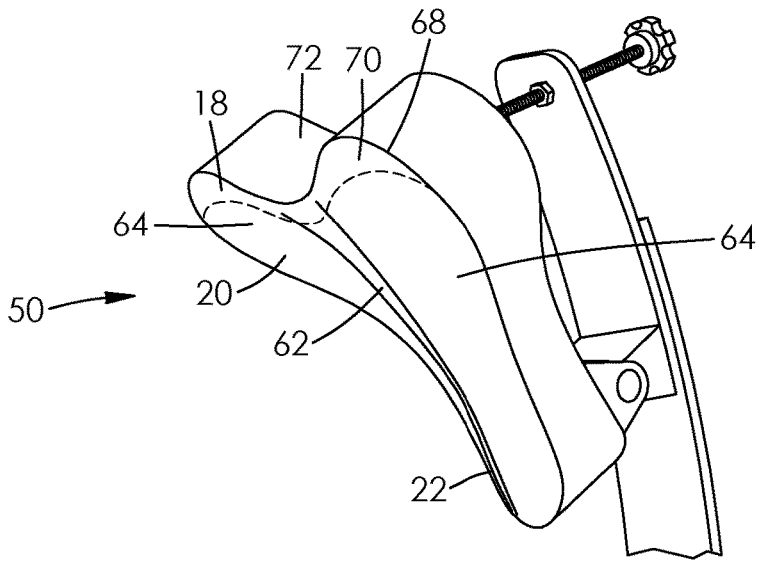
Figure 3B:
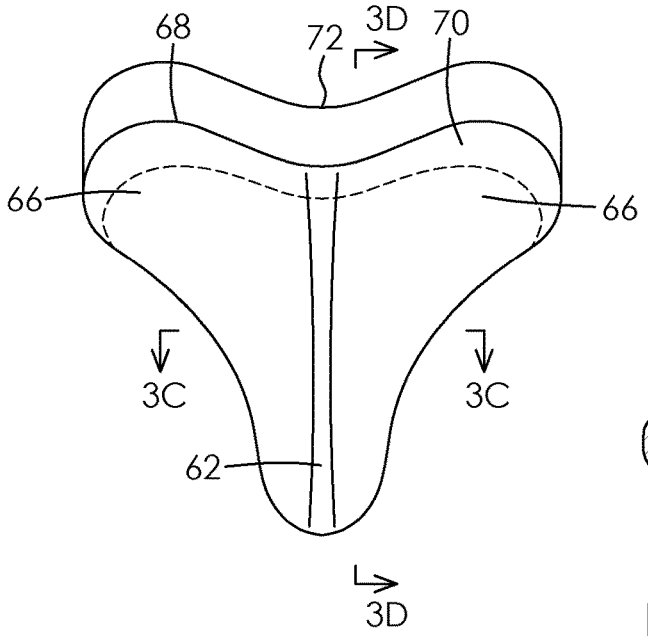
Figure 3C:
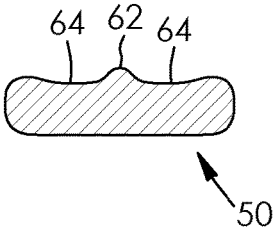
Figure 3D:
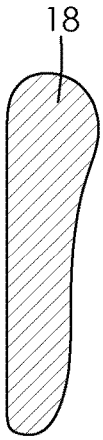

FIG. 3A is a perspective view of the support unit of FIG. 1; FIG. 3B is a top perspective view of the support unit; FIG. 3C is a sectional view through line 3C of FIG. 3B; and FIG. 3D is a sectional view through line 3D of FIG. 3B.

Figure 4:
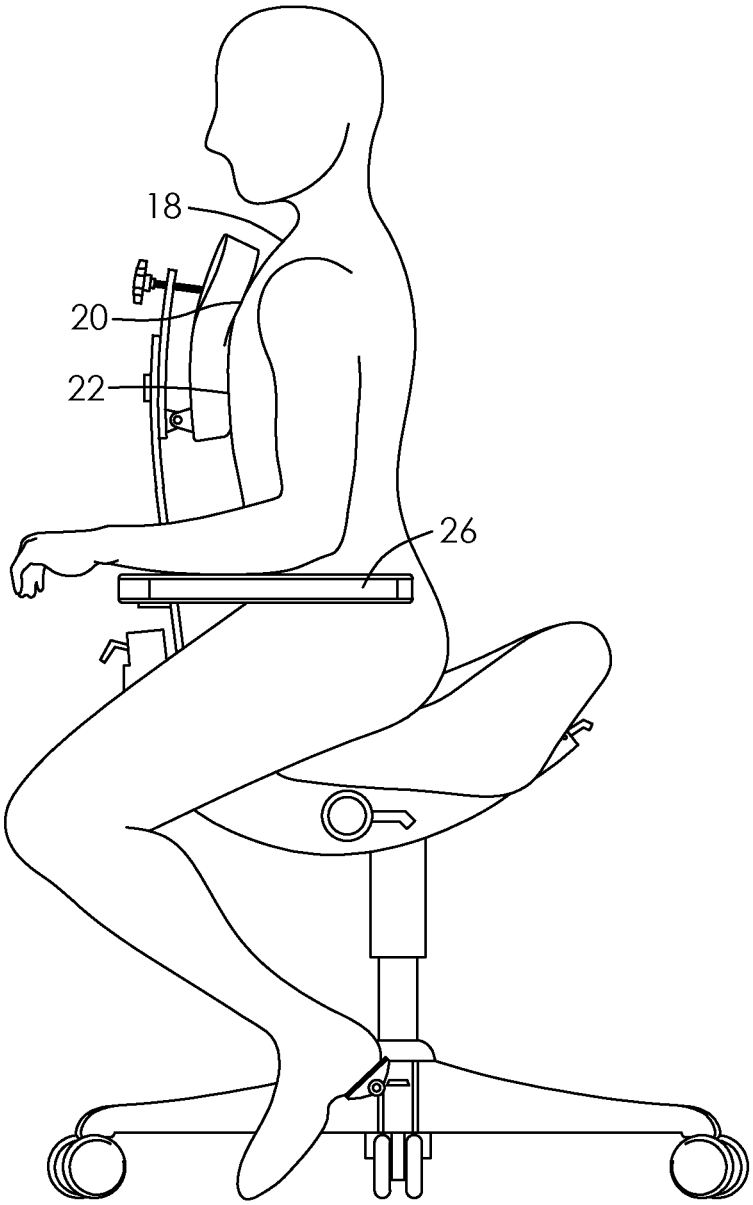

FIG. 4 is a side view of a user in the ventral position on the chair of FIG. 1.

Figure 5:
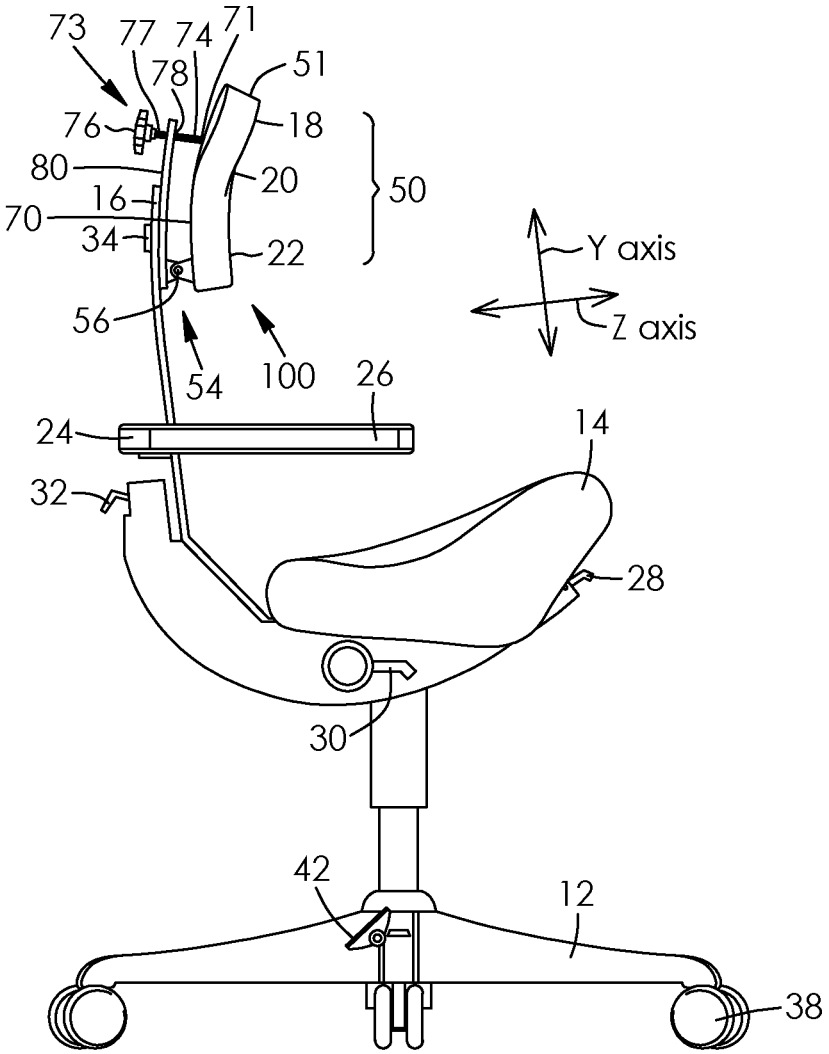

FIG. 5 is a side view showing the adjustors for the support unit.

Figure 6:
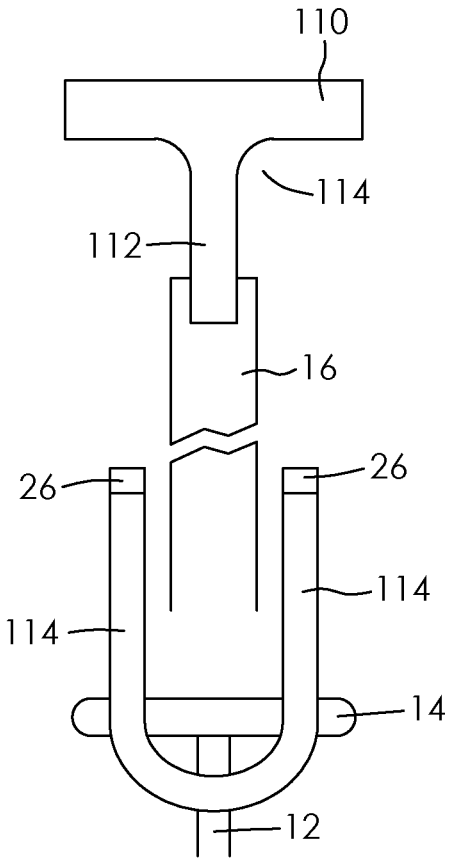

FIG. 6 is a face view of the support unit of an alternative embodiment and of the horizontal forearm support.

DESCRIPTION

Except as otherwise expressly provided, the following rules of interpretation apply to this specification (written description, and claims): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning "including, but not limited to,") unless otherwise noted.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

The design of the ergonomic chair creates anterior support to the human frame in the seated, slightly leaning forward, position. The sternum support encourages lumbar and cervical lordosis while minimizing thoracic kyphosis. The forearm supports reduces lower spinal compression through bracing or downward forearm pressure. The body is not forced into a position, which could be an abnormal position with the supports, but rather the supports passively encourage the body into its normal posture.

There is also some support that occurs from direct pressure on the costocartilage, which are the structures that connect the sternum to the ribs anteriorly. The general support comes from the sternum, sterno-clavicular joints, costocartilage and then through the ribs which in turn support the spine. There is also additional support from the sternum, sternoclavicular joints and clavicles.

An ergonomic chair, generally referred to as 8 is shown in FIG. 1. It has legs 10, a seat post 12, a seat 14, an Y axis member 16 that retains: an support unit 50 that has a clavicles support zone 18, an upper sternum support zone 20 and a lower sternum support zone 22; a horizontal forearm member 24 that retains a pair of forearm supports 26; and a seat tilt adjustor 28. The seat tilt adjustor optimizes lumbar lordosis. The seat 14 is preferably a saddle shape with the distal end 90 being wider than the proximal end 92. It has a slight concavity 94, which allows a user to adjust their pelvic tilt by shifting forward or backward on the seat 14 to a position that is most comfortable. The Y axis member 16 and the horizontal forearm member 24 are normal to one another and are on the Y axis and the X axis, respectively (See FIG. 2). In one embodiment, the horizontal forearm member 24 curves rearward towards the distal end 90 of the seat 14 from the Y axis member 16 and the forearm supports 26 extend backwards from the horizontal forearm member 24 towards the distal end 90 of the seat 14. The Y axis member 16 is a two-part extendable member, usually provided with a slot on a first member and a threaded aperture on a second member, the threaded aperture for accepting a knob, the slot, aperture and knob functioning as an Y axis length adjustor 34. The Y axis member 16 is flexible and is preferably a steel strap that includes a concave curve 96 with its radius 98 behind the proximal end 92 of the seat 14, in other words the concavity 96 faces towards the distal end 90 of the seat 14.

Figure 2:
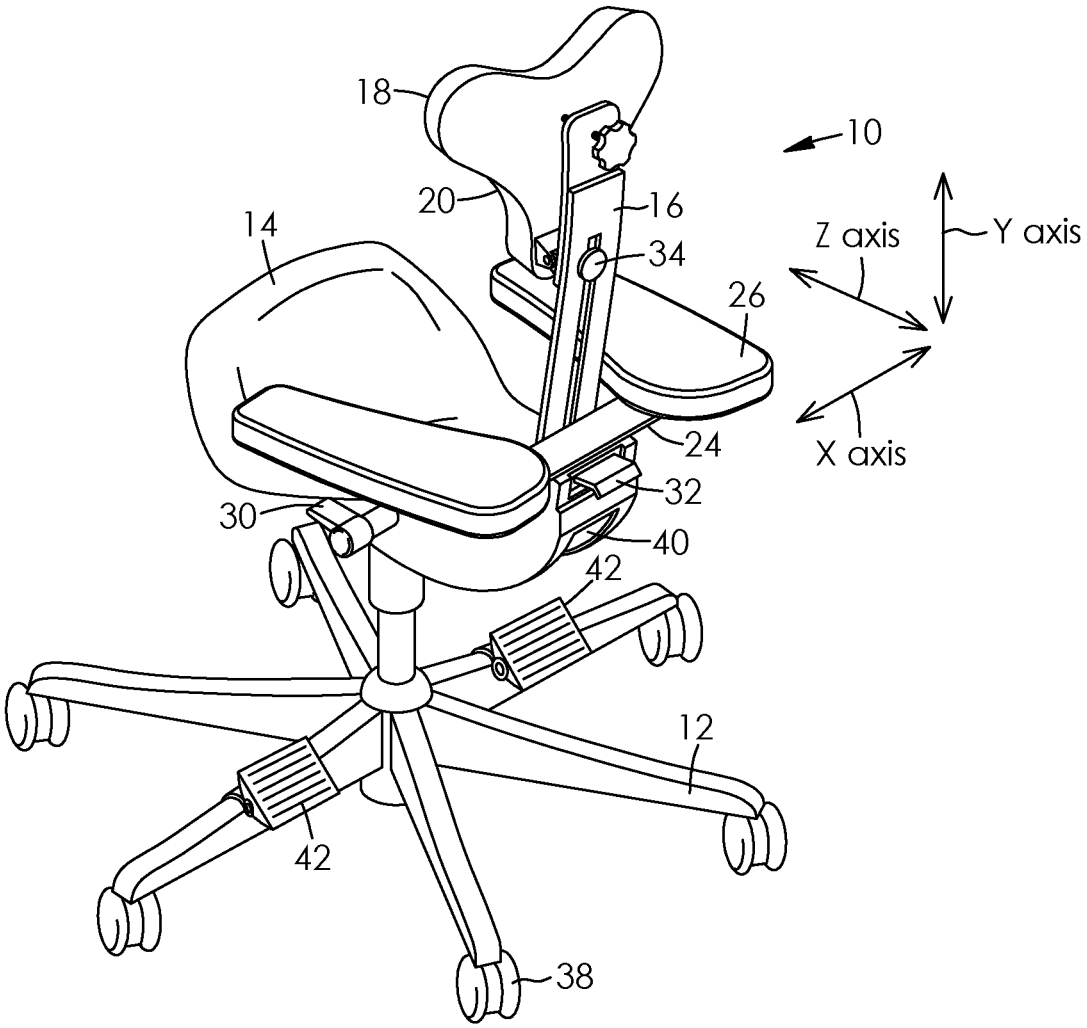
FIG. 2 is a rear perspective view of the chair of FIG. 1.

As shown in FIG. 2, it also has a seat height adjustor 30, a forearm support height adjustor 32, and the Y axis member length adjustor 34. The seat height adjustor 30, forearm support height adjustor 32 and Y axis member length adjustor 34 allow for independent movement of the seat 14, horizontal forearm member 24 and the Y axis member 16 in the Y axis. Placement of the forearm supports 26 along the X axis is done by loosening the support clamps 36 (FIG. 1) and moving the support 26 in or out from the Y axis. The chair 8, as shown, has casters 38 on each leg 12. The Y axis member 16 is biased with an adjustable biasing member, which is preferably a tensioning spring 40, allowing a user to lean into the supports 18, 20, 22. Foot rests 42 are present on at least two of the legs 10. The support unit is covered in a covering 51, at least on the surface contacting a user.

As shown in FIG. 3A-3D, a heart-shaped support unit generally referred to as 50 includes the clavicles support zone 18, upper sternum support zone 20 and lower sternum support zone 22. The upper sternum support zone 20 and the lower sternum support zone 22 forma central ridge 62 to directly support the sternum. As shown in FIG. 3C, there is a concavity 64 in each lobe 66 of the heart, defined in part by the central ridge 62. The concavity 64 accepts the breasts or the pectoral muscles of the chest. The rounded corner 68 and proximate area 70 (indicated with a dashed line) directly support the clavicles. The raised clavicles support zone 18 also defines the concavity 64. The valley 72 between the lobes 66 follows the contour of the clavicles. The support unit 50 has a defined shape and has a metal frame and a cover 51, which is filled with a foam material having a Shore Durometer of about 70 to 90 on the OO scale.

The integrated support 50 is anatomically correct. It can be adjusted in and out at the top and bottom and can pivot about the top and the bottom to allow for maximum adjustability.

In one embodiment, the support unit can replace the standard seat back of an office chair.

FIG. 4 shows a user supported ventrally. It can be seen that the clavicles support zone 18 abuts the user's clavicles, the upper sternum support zone 20 support abuts the user's upper sternum and the lower sternum support zone 22 support abuts the user's lower sternum.

As shown in FIG. 5, a Z axis member, generally referred to as 54 is attached to the rear 70 of support unit 50 and a Z axis member adjustor 56. The Z axis member 54 is normal to both the Y axis member 16 and the forearm support member 24, thus being on the Z axis. This allows the user to move the support unit 50 in and out along the Z axis from the Y axis member 16. A two-part extendable member, usually provided with a slot on a first member and a threaded aperture on a second member, the threaded aperture for accepting a knob, the slot, aperture and knob functioning as the Z axis member adjustor 56. Alternatively, it may be telescoping. A proximal end 71 of an upper adjustor, generally referred to as 73 is attached to the rear 70 of the support unit 50 above the Z axis member 54. It is a rod with a threaded portion 74 and a knob 76 at the distal end 77. The rod is threadedly engaged with an aperture 78 in the Y axis member 16 or in an integrated support system Y axis member 80. This allows for pivoting or tilting the support unit 50. The support unit, Z axis member with its extendible member and the upper adjustor are an integrated support system, generally referred to as 100. The height of support unit 50 can be changed by adjusting the Y axis member 16 with the adjustor 34 or by adjusting the height of a second Y axis member 80.

In an alternative embodiment shown in FIG. 6, the support unit 50 is T-shaped with the horizontal support 110 for the clavicles and a vertical support 112 for the sternum. The space 114 between the two supports 110, 112 accepts the soft tissue of the chest of the user.

Also shown in FIG. 6, is an alternative embodiment in which the horizontal forearm member 24 is replaced with a pair of arms 114 that are attached to the forearm supports 26 at one end and attached to the base 116 of the seat 14 or the seat post 12 at the other end. This allows the Y axis member 16 to be independent from the forearm supports 26.

In use, the user adjusts the supports along the X, Y and Z axis as needed and sits in the ventral position. Seat height, seat tilt, arm support height, distance between the arm supports, angle of the Y axis member, height of the support unit and tilt of the support unit can all be adjusted. In the ventral position, the user is supported on the clavicles and upper sternum by the chair front (integrated support member and Y axis member), allowing the cervical spine and lumbar spine to settle into their natural lordosis. The chair front does not press or force the spine into a position. The lower sternum is also supported but is not critical to positioning of the user's spine in it natural position. The user simply sits in the chair, contacts the supports and leans slightly into them. By pressing slightly on the forearm support, the user decompresses their spine.

Example

Twenty adult males with no history of spinal fracture, spinal surgery, tumor, inflammatory arthropathy, and/or a back-pain episode in the last 6 months were recruited from the local population. Two, 1-hour sitting sessions in the morning at the same time of day and at least twenty-four hours apart were completed using a prototype chair of the present technology, designed to minimize spine compression, which was compared to a control configuration (the saddle seat pan of the prototype chair alone). The chair conditions were randomly presented between days using simple randomization. All participants completed the informed consent process prior to starting the study.

Seated spine height, measured with digital stadiometer and perceived back pain, measured with a digital 100 mm visual analog scale, were taken immediately before and after the 1-hour sitting trial. During the one hour sitting trial, accelerometer and seat pressure were collected continuously. A qualitative questionnaire (5 point Likert scale, 1 being 'strongly disagree' and 5 being 'strongly agree') assessing perceived support, comfort, tiredness, and stiffness was completed after the final spine height measure at the end of each experimental session.

A one-way general linear ANOVA was used to compare the following variables between chair conditions: change in spine height, average lumbar and pelvic angles during the sitting trial, change in perceived pain throughout the sitting trial, average seat pressure, peak pressure, average seat contact area, and average center of pressure (COP) location by Row and Column of the pressure mat. The level of significance was set at $p \leq 0.05$.

Spine Height:

Spine height change was significantly smaller in the decompression design condition (−0.08 cm±0.38 cm) compared to the control condition (−0.62±0.04 cm; $p=0.00$, $\eta 2=0.32$).

Seat Pressure:

Contact area on the seat pan was significantly smaller during the decompression design condition (863.42±85.56 cm2) than during the control condition (908.85±49.07 cm2; $p=0.49$, $\eta 2=0.10$). Participants sat significantly more anterior on the seat pan in the decompression design condition (CoP Row 20.56±1.67 cm) compared to control condition (18.03±1.92 cm; $p=0.00$, $\eta 2=0.34$). There were no significant differences for the COP Column co-ordinate (side to side) between the decompression design (21.48±0.98 cm) and control conditions (21.46±0.07 cm; $p=0.94$, $\eta 2=0.00$). Average and peak pressures were also not significantly different ($p=0.38$, $\eta 2=0.02$ and $p=0.24$, $\eta 2=0.04$) between the decompression design (0.66±0.04 and 2.68±0.63 N/cm2) and control conditions (0.64±0.08 and 2.42±0.70 N/cm2).

Spine Angles:

Average lumbar and pelvic angles were not significantly different between the chair conditions. Specifically, the average lumbar angles (in both degrees and % ROM) for the decompression design and control conditions were 0.80±11.24° (56.24±19.90% ROM) and 0.02±11.26° (54.52±19.43% ROM) respectively ($p=0.83$, $\eta 2=0.00$ and $p=0.79$, $\eta 2=0.00$). Average pelvic angles (in both degrees and degrees relative to upright standing) for the decompression design and control conditions were 1.68±0.88° (5.25±2.38°) and 1.54±0.80° (4.30±2.28°) respectively ($p=0.62$, $\eta 2=0.01$ and $p=0.22$, $\eta 2=0.04$).

Perceived Low Back Pain:

The average change in pain for the low back was generally low and not significantly different between the decompression design (1.66±4.59 mm) and control configuration (3.93±8.25 mm; $p=0.31$, $\eta 2=0.029$). Similarly, the average change in perceived pain for the gluteal region was not significantly different between the decompression design (8.97±10.85 mm) and control condition (13.74±12.20 mm; $p=0.21$, $\eta 2=0.043$).

Exit Questionnaire:

The exit questionnaire showed that participants found the decompression design condition more supportive (3.89) than the control condition (2.80; $p=0.01$, $\eta 2=0.25$). Participants indicated more often that they would have liked more support from the decompression (3.45) than the control condition provided (2.56; $p=0.30$, $\eta 2=0.12$). No significant differences between the decompression design and the control condition were found when the participants were asked if the chair allowed them to sit with an upright posture (4.33 and 4.00; $p=0.28$, $\eta 2=0.03$), if the chair matches their idea of a standard office chair (2.28 and 2.40; $p=0.75$, $\eta 2=0.03$), or their back feels stiff (2.56 and 2.60; $p=0.90$, $\eta 2=0.00$) or tired (2.28 and 2.79; $p=0.27$, $\eta 2=0.03$) after the sitting exposure.

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize, or be able to ascertain using no more than routine experimentation, many equivalents to the specific example embodiments specifically described herein. Such equivalents are intended to be encompassed in the scope of the claims, if appended hereto or subsequently filed.

The invention claimed is:

1. A ventral support for use in an ergonomic work station chair, the ventral support comprising an extendible, flexible Y axis member and a support unit, the support unit pivotally attached to the extendible, flexible Y axis member, wherein the support unit is heart-shaped and includes a rear, a face, and a top therebetween, the face including a right lobe and a left lobe, a clavicles support, which has a right side and a left side, is raised, is proximate the top and is horizontally disposed, and a central ridge, which extends vertically downward from the clavicles support, wherein the right lobe, the right side and the central ridge define a right concavity in the face and the left lobe, the left side and the central ridge define a left concavity in the face.

2. The ventral support of claim 1, further comprising a horizontal forearm member and a forearm support height adjustor, the forearm support height adjustor attached to the extendible, flexible Y axis member.

3. The ventral support of claim 2, further comprising support clamps attached to the extendible, flexible Y axis member and the horizontal forearm member.

4. The ventral support of claim 1, further comprising a Z axis member, which is a threaded rod including a distal end and a proximal end, the proximal end attached to the rear of the support unit and the distal end including a knob and extending through the extendible, flexible Y axis member.

5. The ventral support of claim 4, further comprising a second Z axis member attached to the rear of the support unit and the extendible, flexible Y axis member, the second Z axis member disposed below the Z axis member.

6. The ventral support of claim 5, wherein the second Z axis member is pivotally attached to the rear of the support unit and the extendible, flexible Y axis member.

7. An upper body support for use in an ergonomic work station chair, the upper body support comprising: an adjustable Y axis member; a support unit, the support unit pivotally attached to the extendible, flexible Y axis member, wherein the support unit includes a rear, a face, and a top therebetween, the face including a right lobe and a left lobe, a clavicles support which has a right side and a left side, is raised, is proximate the top and is horizontally disposed, and a central ridge, which extends vertically downward from the clavicles support, wherein the right lobe, the right side and the central ridge define a right concavity in the face and the left lobe, the left side and the central ridge define a left concavity in the face; a Z axis member, the Z axis member including a distal end and a proximal end, the proximal end attached to the rear of the support unit and the distal end attached to the extendible, flexible Y axis member; an adjustable horizontal forearm member, which is independently vertically adjustably mounted to the Y axis member; and a pair of forearm supports horizontally adjustably mounted on the adjustable horizontal forearm member.

8. The upper body support of claim 7, wherein the Z axis member is independently adjustably attached to the rear of the support unit and the extendible, flexible Y axis member.

9. The upper body support of claim 8, comprising two Z axis members each adjustably attached to the rear of the support unit and the extendible, flexible Y axis member, to allow in and out movement and tilting of the support unit.

10. An ergonomic work station chair comprising a plurality of legs, a seat post centrally mounted on the plurality of legs, a seat mounted on the seat post, the seat including a distal end and a proximal end, and an upper body support, the upper body support including:

an extendible, flexible Y axis member, the extendible, flexible Y axis member adjustably attached to the seat;

a support unit, the support unit pivotally attached to the extendible, flexible Y axis member, wherein the support unit includes a rear, a face, and a top therebetween, the face including a right lobe and a left lobe, a clavicles support which has a right side and a left side, is raised, is proximate the top and is horizontally disposed, and a central ridge, which extends vertically downward from the clavicles support, wherein the right lobe, the right side and the central ridge define a right concavity in the face and the left lobe, the left side and the central ridge define a left concavity in the face;

an adjustable horizontal forearm member, which is independently vertically adjustably mounted on the extendible, flexible Y axis member; and a pair of forearm supports horizontally adjustably mounted on the adjustable horizontal forearm member and extending rearward towards the distal end of the seat.

11. The ergonomic work station chair of claim 10, further comprising a forearm support height adjustor mounted on the extendible, flexible Y axis member for moving the horizontal forearm member up and down independently from the support unit.

12. The ergonomic work station chair of claim 11, further comprising a Y axis member length adjustor mounted on the extendible, flexible Y axis member for adjusting a length of the extendible, flexible Y axis member.

13. The ergonomic work station chair of claim 12, further comprising a Z axis member, which is a threaded rod including a distal end and a proximal end, the proximal end attached to the rear of the support unit and the distal end including a knob and extending through the extendible, flexible Y axis member.

14. The ergonomic work station chair of claim 13, further comprising a second Z axis member attached to the rear of the support unit and the extendible, flexible Y axis member, the second Z axis member disposed below the Z axis member.

15. The ergonomic work station chair of claim 14, wherein the second Z axis member is pivotally attached to the rear of the support unit and the extendible, flexible Y axis member.

16. A method of promoting a user's natural cervical lordosis and lumbar lordosis, the method comprising: the user sitting in the ergonomic work station chair of claim 10; the user contacting the clavicles support with their clavicles and the central ridge with their sternum; and the user leaning into the clavicles support and the central ridge, thereby promoting the user's natural cervical lordosis and lumbar lordosis.

17. The method of claim 16 further comprising the user decompressing their lumbar spine by pressing their forearms into the forearm supports.

18. The method of claim 17, further comprising adjusting the adjustable horizontal forearm member up and down to maximize proper positioning of the user.

19. The method of claim 18, further comprising adjusting the support unit up or down to maximize positioning of the user.

20. The method of claim 19, further comprising tilting the support unit to maximize positioning of the user.

* * * * *